US010203189B2

(12) United States Patent
Park

(10) Patent No.: US 10,203,189 B2
(45) Date of Patent: Feb. 12, 2019

(54) FUSE HOUSING STRUCTURE AND METHOD FOR MANUFACTURING THE SAME

(71) Applicant: Joo Tae Park, Daegu (KR)

(72) Inventor: Joo Tae Park, Daegu (KR)

( * ) Notice: Subject to any disclaimer, the term of this patent is extended or adjusted under 35 U.S.C. 154(b) by 0 days.

(21) Appl. No.: 15/915,398

(22) Filed: Mar. 8, 2018

(65) Prior Publication Data

US 2018/0292192 A1 Oct. 11, 2018

(30) Foreign Application Priority Data

Apr. 5, 2017 (KR) ..... 10-2017-0044449

(51) Int. Cl.
*F42C 19/02* (2006.01)
*F42B 33/00* (2006.01)
*F42B 39/20* (2006.01)

(52) U.S. Cl.
CPC ..... *F42C 19/02* (2013.01); *F42B 33/00* (2013.01); *F42B 39/20* (2013.01)

(58) Field of Classification Search
CPC ..... F42B 12/20; F42B 12/207; F42B 30/08; F42B 30/10; F42B 39/00; F42B 39/14; F42B 39/20; F42B 33/00; F42B 33/001; F42B 33/0278; F42B 99/00; F42C 19/02; F42C 19/00; F42C 99/00
USPC ..... 102/473, 481, 293; 86/51, 1.1
See application file for complete search history.

(56) References Cited

U.S. PATENT DOCUMENTS 7,353,755 B2 * 4/2008 Aumasson ..... F42B 39/20 102/481
7,739,956 B2 * 6/2010 Ljungwald ..... F42B 39/20 102/481
9,964,387 B2 * 5/2018 Fink ..... F42B 39/20

FOREIGN PATENT DOCUMENTS

KR 10-1598975 B1 3/2016

* cited by examiner

*Primary Examiner* — James S Bergin
(74) *Attorney, Agent, or Firm* — Egbert Law Offices, PLLC

(57) ABSTRACT

A fuse housing structure including: a fuse housing coupled to a projectile and having a first surface exposed to the outside, a second surface hidden to the interior of the projectile, and a through-hole portion formed between the first surface and the second surface; and a position part deformed by an external force, in the state of being inserted into the through-hole portion, in such a manner as to be coupled to the fuse housing, the position part including a large diameter portion having a first outer diameter, an outer diameter reduction portion connected to one side of the large diameter portion, and a deformation portion protruding from the other side of the large diameter portion in such a manner as to be inserted into the through-hole portion by means of the deformation caused by the external force.

5 Claims, 11 Drawing Sheets

FUSE HOUSING STRUCTURE AND METHOD FOR MANUFACTURING THE SAME

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to a fuse housing structure and a method for manufacturing the same, and more particularly, to a fuse housing structure that has a position part adapted to control erroneous explosion preventing means and explosion time so as to allow a projectile or shell to be delivered, handled, or charged for fired in a safe manner and to a method for manufacturing the fuse housing structure.

2. Description of Related Art Including Information Disclosed Under 37 CFR 1.97 and 37 CFR 1.98

FIGS. 1*a* and 1*b* are front views showing a shell or projectile to which a fuse 100 is coupled, wherein FIG. 1*a* shows a mortar shell and FIG. 1*b* is a shell, and FIG. 2 is an exploded perspective view showing the fuse 100 of the mortar shell of FIG. 1*a*.

As shown in FIGS. 1*a* to 2, a shell like the mortar shell (See FIG. 1*a*) is coupled to the fuse 100 having various functions so as to perform explosion at a desired time point after fired or to prevent erroneous explosion at an undesired time point after fired.

In case of an 155 mm type field artillery shell, for example, the fuse 100 is coupled to the front portion of the projectile or shell by means of a screw, a strong setback force reaching an acceleration ranging from one hundred thousand to tens of thousands G is generated upon the firing of the shell. Further, a centrifugal force is generated as the shell rotates at a high speed by means of a wire in a barrel. Through the operations, explosion means starts to operate.

An operating time point of the fuse 100 may be in advance set upon manufacturing, but generally, it is set appropriately according to required performance, characteristics of high explosives charged in the shell, and dispersion characteristics of a bomblet or broken pieces generated from the bomblet and is then inputted before the shell is fired.

The fuse 100 is configured to have erroneous explosion prevention means adapted to prevent the shell from being exploded just after fired, and the erroneous explosion prevention means is coupled to the fuse 100 in the state where an explosive initiator of the fuse 100 is physically blocked from the high explosive or bomblet charged in the shell by means of a blocking member (having no reference numeral). The blocking member operates independently of a controller of the fuse 100 in such a manner as to release the physical blocking state when a given period of time passes after the shell has been fired. Accordingly, the shell before fired is safe from the erroneous explosion of the fuse 100, and the shell is also kept and delivered safely in the state of mounting the fuse 100 thereon.

Even if the malfunction of the fuse 100 occurs at the same time when the shell is fired, further, application of an explosive force to the interior of the shell is prevented up to a given period of time after the shell has been fired, thereby keeping the shell from being exploded in an army.

The above-mentioned technology is in detail disclosed in Korean Patent Registration No. 10-1243770.

BRIEF SUMMARY OF THE INVENTION

Accordingly, the present invention has been made in view of the above-mentioned problems occurring in the prior art, and it is an object of the present invention to provide a fuse housing structure and a method for manufacturing the same that are capable of coupling a position part to a fuse housing in simple, easy, precise, and accurate manners.

To accomplish the above-mentioned object, according to a first aspect of the present invention, there is provided a fuse housing structure including: a fuse housing coupled to a projectile and having a first surface exposed to the outside, a second surface hidden to the interior of the projectile, and a through-hole portion formed between the first surface and the second surface; and a position part deformed by an external force, in the state of being inserted into the through-hole portion, in such a manner as to be coupled to the fuse housing, the position part comprising a large diameter portion having a first outer diameter, an outer diameter reduction portion connected to one side of the large diameter portion in such a manner as to allow one side connected to one side of the large diameter portion to have the first outer diameter and to allow the other side thereof to have the first outer diameter reduced gradually, and a deformation portion protruding from the other side of the large diameter portion in such a manner as to be inserted into the through-hole portion by means of the deformation caused by the external force, and the through-hole portion comprising a first through-hole portion depressed from the second surface of the fuse housing and having a shape corresponding to the shape of the outer diameter reduction portion, a second through-hole portion communicating with the first through-hole portion and having a shape corresponding to the shape of the large diameter portion, and a third through-hole portion depressed from the first surface and communicating with the second through-hole portion, wherein a size of space formed by the third through-hole portion is equal to or larger than a size of volume of the deformation portion deformed by the external force, the outer diameter reduction portion has a stepped portion spirally formed in an insertion direction, the first through-hole portion has a stepped portion correspondence portion formed thereon to have a shape corresponding to the stepped portion so that while the position part is being inserted into the through-hole portion, the position part rotates along the through-hole portion by means of the contact between the stepped portion and the stepped portion correspondence portion, and when the rotation of the position part is finished, the other side surface of the outer diameter reduction portion is located on the same plane as the second surface.

According to the present invention, desirably, the outer diameter reduction portion includes a first parallel portion where the first outer diameter is constantly maintained and a second parallel portion having a second outer diameter smaller than the first outer diameter, and the stepped portion is formed between the first parallel portion and the second parallel portion.

According to the present invention, desirably, the third through-hole portion has a first inner diameter larger than the first outer diameter, and the deformation portion includes a first curved surface having an outer diameter larger than the first outer diameter and smaller than the first inner diameter in such a manner as to be curved in an outward radial direction, a second curved surface having an inner diameter smaller than the first outer diameter in such a manner as to be curved in an inward radial direction, and a connection surface connecting the first curved surface and the second curved surface with each other.

According to the present invention, desirably, the connection surface includes a first slant surface opposing the first curved surface in such a manner as to form a given slant surface with respect to the first surface, a second slant surface opposing the second curved surface in such a manner as to form a given slant surface with respect to the first surface, and a contact surface connecting the first slant surface and the second slant surface with each other in such a manner as to come into contact with an external force application part from which the external force is applied, so that a small angle in angles formed by the imaginary plane extended from the contact surface and the first surface is an acute angle and if the external force is applied to the contact surface, the first curved surface and the first slant surface come into contact with each other to allow the deformation portion to be inserted into the third through-hole portion, and the boundary area between the first curved surface and the first slant surface is at the innermost position in the inward radial direction.

According to the present invention, desirably, an accommodation space defined by the second curved surface is a space where a rotary member for applying the rotary force to the position part is inserted, so that the position part rotates along the through-hole portion.

To accomplish the above-mentioned object, according to a second aspect of the present invention, there is provided a method for manufacturing a fuse housing structure, the method including the steps of: machining a cut metal round bar to a shape of a fuse housing through a lathe; machining a through-hole portion in such a manner as to pass through a first surface exposed to the outside and a second surface hidden to the interior of a projectile; making a position part by machining a large diameter portion having a first outer diameter, an outer diameter reduction portion connected to one side of the large diameter portion in such a manner as to allow one side connected to one side of the large diameter portion to have the first outer diameter and to allow the other side thereof to have the first outer diameter reduced gradually, and a deformation portion protruding from the other side of the large diameter portion; machining a stepped portion along the outer peripheral surface of the outer diameter reduction portion; inserting the position part into the through-hole portion; applying an external force to the deformation portion protruding from the first surface; and allowing the external surface of the deformation portion and the first surface to be located on the same curved surfaces as each other through turning.

BRIEF DESCRIPTION OF THE SEVERAL VIEWS OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE INVENTION

Figure 1A:
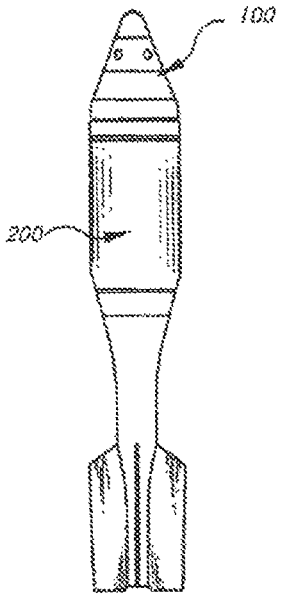
FIG. 1a Prior Art
FIGS. 1*a* and 1*b* are front views showing a shell or projectile to which a fuse is coupled.
Figure 1B:
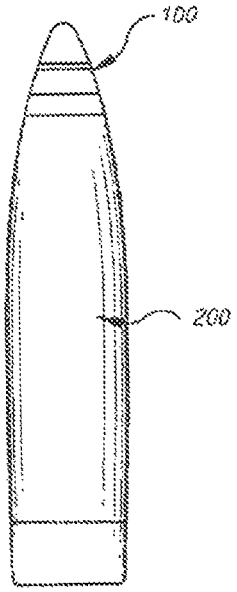
FIG. 1b Prior Art
Figure 2:
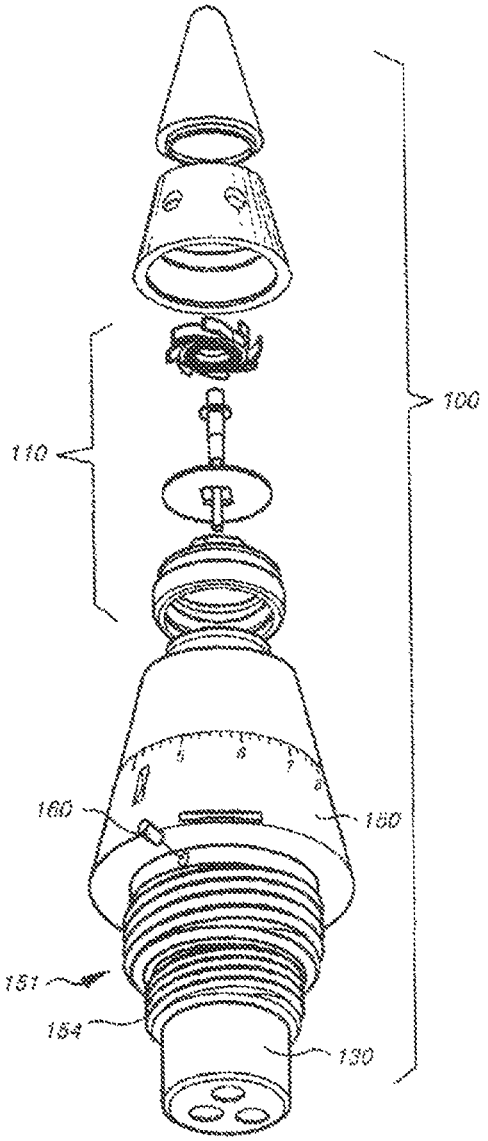
FIG. 2 Prior Art
FIG. 2 is an exploded perspective view showing a fuse of a mortar shell of FIG. 1*a;*

Hereinafter, an explanation on a fuse housing structure and a method for manufacturing the same according to the present invention will be in detail described with reference to the attached drawing. The present invention may be modified in various ways and may have several exemplary embodiments. Specific exemplary embodiments of the present invention are illustrated in the drawings and described in detail in the detailed description. However, this does not limit the invention within specific embodiments and it should be understood that the invention covers all the modifications, equivalents, and replacements within the idea and technical scope of the invention.

In the description, it should be noted that the parts corresponding to those of the drawings are indicated by corresponding reference numerals.

Figure 3:
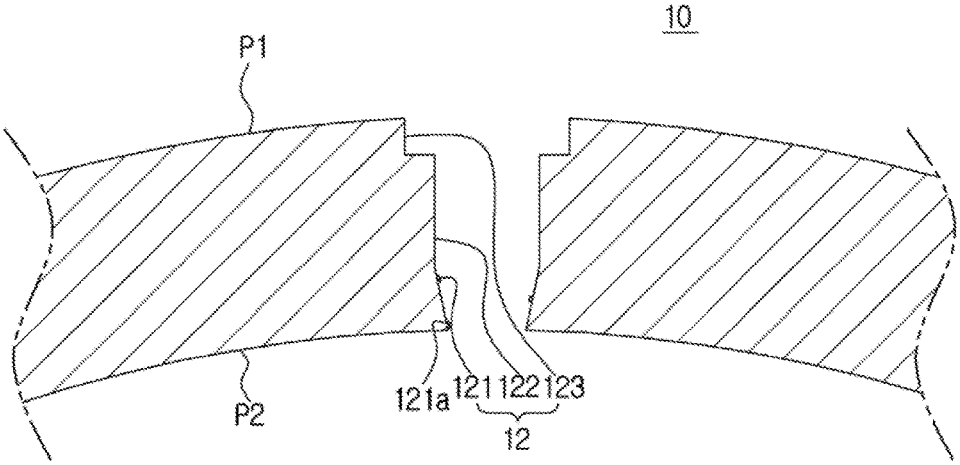
FIG. 3 is a schematic view showing a fuse housing structure according to the present invention.
Figure 4:
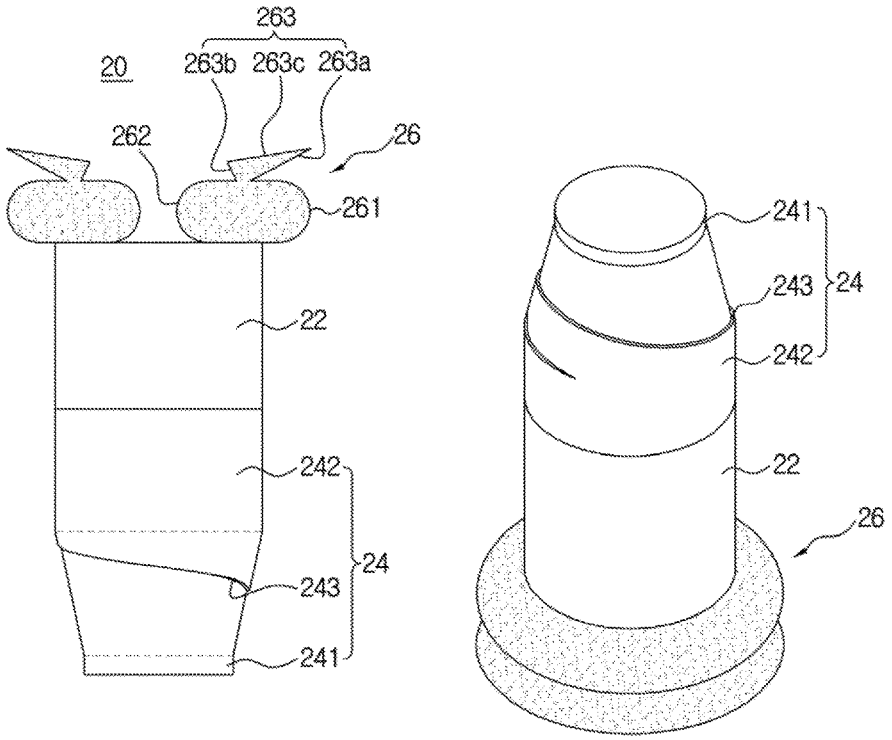
FIG. 4 is a schematic view showing a fuse housing of the fuse housing structure according to the present invention.

FIG. 3 is a schematic view showing a fuse housing structure according to the present invention, and FIG. 4 is a schematic view showing a fuse housing of the fuse housing structure according to the present invention.

As shown in FIGS. 3 and 4, a fuse housing structure 1 according to the present invention includes a fuse housing 10 coupled to a projectile or shell and a position part 20 coupled to the fuse housing 10.

The fuse housing 10 includes a first surface P1 exposed to the outside, a second surface P2 hidden to the interior of the projectile, and a through-hole portion 12 formed between the first surface P1 and the second surface P2.

The position part 20 is deformed by an external force in the state of being inserted into the through-hole portion 12 and is thus coupled to the fuse housing 10. The position part 20 has a shape of a cylinder.

In more detail, the position part 20 includes a large diameter portion 22 having a first outer diameter, an outer diameter reduction portion 24, and a deformation portion 26.

The outer diameter reduction portion 24 is connected to one side of the large diameter portion 22. In this case, one side of the outer diameter reduction portion 24 connected to one side of the large diameter portion 22 has the first outer diameter, and the first outer diameter is reduced gradually toward the other side of the outer diameter reduction portion 24.

Further, the outer diameter reduction portion 24 includes a first parallel portion 241 where the first outer diameter is constantly maintained and a second parallel portion 242 having a second outer diameter smaller than the first outer diameter.

Furthermore, the outer diameter reduction portion 24 includes a stepped portion 243 formed in an insertion direction. In this case, the insertion direction means the insertion direction of the position part 20 into the fuse housing 10. The stepped portion 243 is formed between the first parallel portion 241 and the second parallel portion 242.

Moreover, the stepped portion 243 is spirally formed along the insertion direction.

The deformation portion 26 protrudes from the other side of the large diameter portion 22 and is inserted into the through-hole portion 12 by means of the deformation caused by the external force. A detailed explanation on the deformation portion 26 will be given later with reference to FIGS. 5 to 10.

The through-hole portion 12 includes a first through-hole portion 121, a second through-hole portion 122, and a third through-hole portion 123.

The first through-hole portion 121 is depressed toward the first surface P1 from the second surface P2 of the fuse housing 10 and has a shape corresponding to the shape of the outer diameter reduction portion 24.

If the position part 20 is inserted into the through-hole portion 12, the outer diameter reduction portion 24 of the position part 20 comes into contact with the first through-hole portion 121.

The second through-hole portion 122 communicates with the first through-hole portion 121 and has a shape corresponding to the shape of the large diameter portion 22. Accordingly, the inner diameter of the second through-hole portion 122 has the same size as the first outer diameter.

If the position part 20 is inserted into the through-hole portion 12, the large diameter portion 22 of the position part 20 comes into contact with the second through-hole portion 122.

Further, the first through-hole portion 121 has a stepped portion correspondence portion 121*a* formed thereon to have a shape corresponding to the stepped portion 243, and while the position part 20 is being inserted into the through-hole portion 12, it rotates along the through-hole portion 12 by means of the contact between the stepped portion 243 and the stepped portion correspondence portion 121*a*.

The third through-hole portion 123 is depressed from the first surface P1 and communicates with the second through-hole portion 122.

In this case, a size of space formed by the third through-hole portion 123 is equal to or larger than a size of volume of the deformation portion 26 deformed by the external force.

Further, the third through-hole portion 123 has a first inner diameter larger than the first outer diameter.

The deformation portion 26, which fills the third through-hole portion 123, includes a first curved surface 261 having an outer diameter larger than the first outer diameter and smaller than the first inner diameter in such a manner as to be curved in an outward radial direction, a second curved surface 262 having an inner diameter smaller than the first outer diameter in such a manner as to be curved in an inward radial direction, and a connection surface 263 connecting the first curved surface 261 and the second curved surface 262 with each other.

In this case, the connection surface 263 includes a first slant surface 263*a* opposing the first curved surface 261 in such a manner as to form a given slant surface with respect to the first surface P1, a second slant surface 263*b* opposing the second curved surface 262 in such a manner as to form a given slant surface with respect to the first surface P1, and a contact surface 263*c* connecting the first slant surface 263*a* and the second slant surface 263*b* with each other in such a manner as to come into contact with an external force application part Q from which the external force is applied.

The first slant surface 263*a* forms the slant surface with respect to the first surface P1, which means that an imaginary plane extended from the first slant surface 263*a* forms the slant surface with respect to the first surface P1.

Further, the second slant surface 263*b* forms the slant surface with respect to the first surface P1, which means that an imaginary plane extended from the second slant surface 263*b* forms the slant surface with respect to the first surface P1.

In this case, the direction of the slant surface formed by the first slant surface 263*a* with respect to the first surface P1 is opposite to the direction of the slant surface formed by the second slant surface 263*b* with respect to the first surface P1.

In more detail, the first slant surface 263*a* forms the slant surface in the outward radial direction of the position part 20, and the second slant surface 263*b* forms the slant surface in the inward radial direction of the position part 20.

Further, the contact surface 263*c* is a surface that is formed by connecting the end of the first slant surface 263*a* and the end of the second slant surface 263*b* and also forms a slant surface with respect to the first surface P1.

Also, a small angle in angles formed by the imaginary plane extended from the contact surface 263*c* and the first surface P1 is an acute angle. If the external force is applied to the contact surface 263*c*, the first curved surface 261 and the first slant surface 263*c* come into contact with each other, and after that, the deformation portion 26 is inserted into the third through-hole portion 123.

In more detail, the contact surface 263*c* protrudes from the first slant surface 263*a* in the outward radial direction, and at this time, the protruding contact surface 263*c* serves as a handle for applying a rotary force required in the process where the position part 20 is inserted into the through-hole portion 12.

Further, an accommodation space defined by the second curved surface 262 is a space into which a rotary member R for applying the rotary force to the position part 20 is inserted, so that the position part 20 can rotate along the through-hole portion 12. That is, the application of the rotary force to the position part 20 with respect to the through-hole portion 12 is carried out by means of the contact surface 263*c* protruding from the first slant surface 263*a* or the rotary member R inserted into the accommodation space defined by the second curved surface 262.

Also, the boundary between the contact surface 263*c* and the first slant surface 263*a* may be rounded unlike the drawings, and at this time, a plurality of protrusions may be formed on the rounded boundary so as to enhance a frictional force against a portion of a user's body.

The deformation of the deformation portion 26 caused by the external force application part Q coming into contact with the contact surface 263*c* will be in detail explained with reference to FIGS. 5 to 10.

FIGS. 5 to 10 are schematic views showing coupling processes of the position part 20 to the fuse housing 10.

Referring to FIGS. 5 to 10, the coupling processes of the position part 20 to the fuse housing 10 will be sequentially explained.

Figure 5:
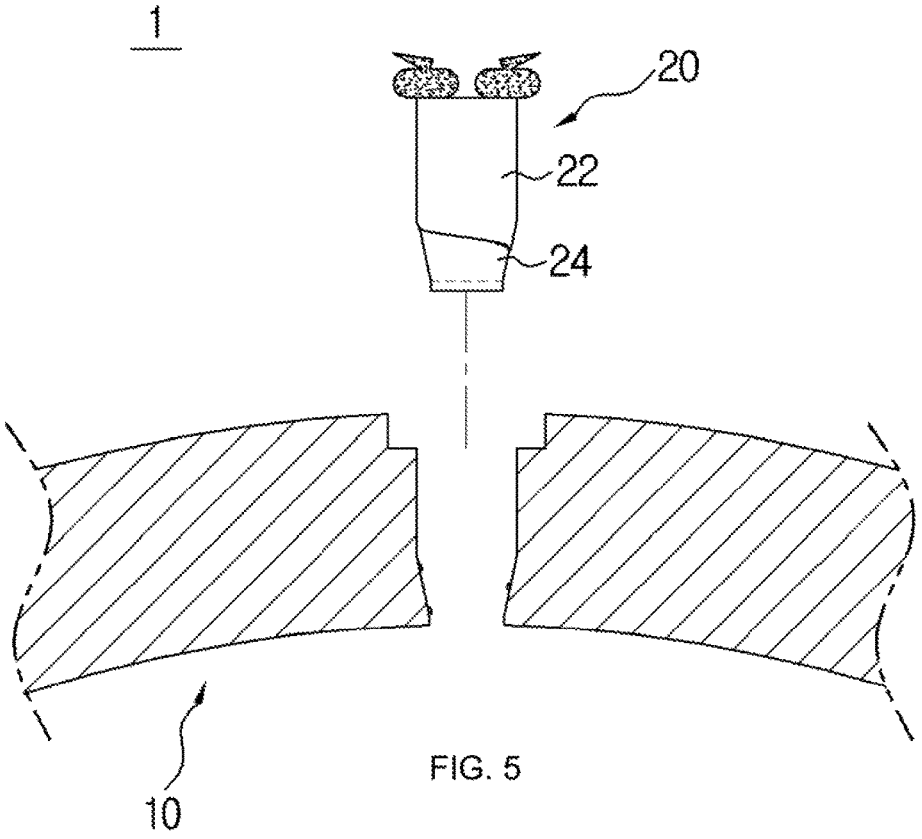
FIGS. 5 to 10 are schematic views showing coupling processes of a position part to the fuse housing in the fuse housing structure according to the present invention.

The fuse housing 10 and the position part 20 are arranged to allow the through-hole portion 12 of the fuse housing 10 to face the outer diameter reduction portion 24 of the position part 20 (See FIG. 5).

Figure 6:
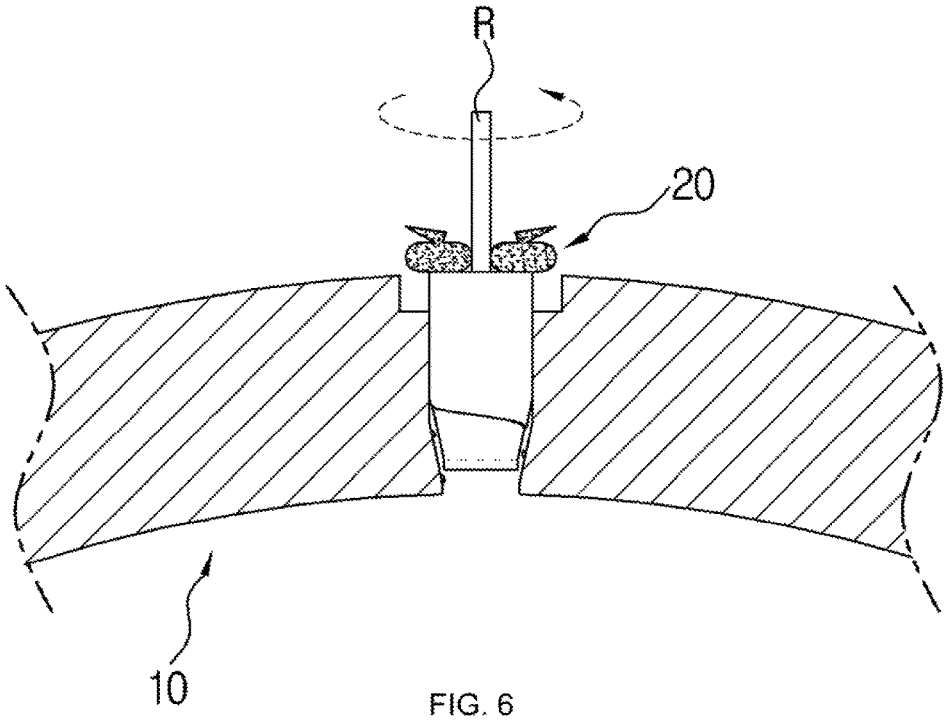
Figure 7:
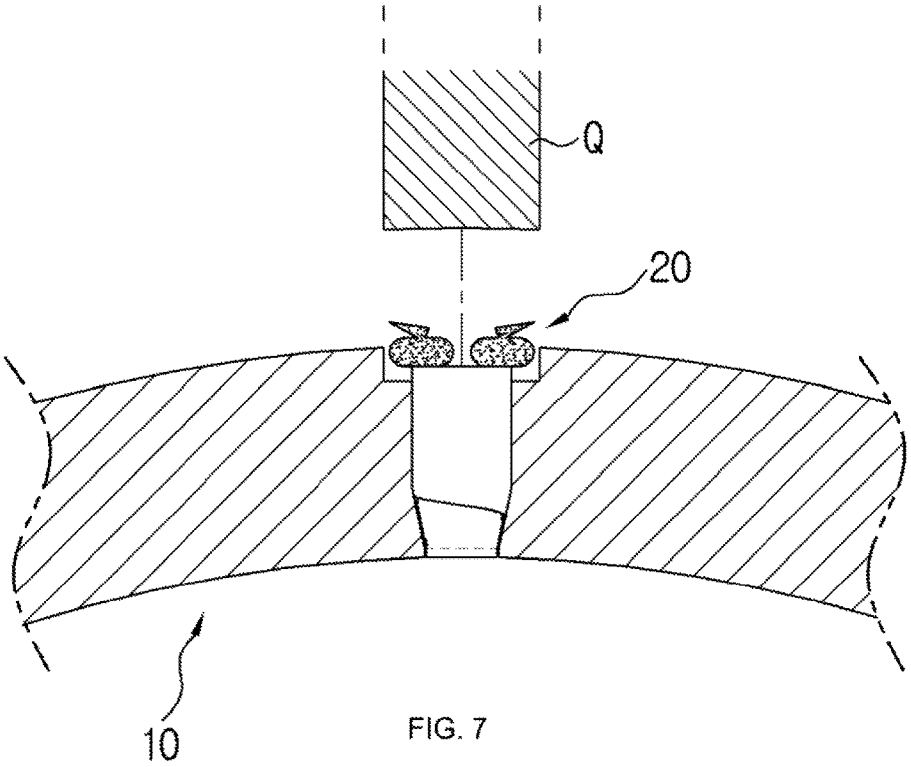

Next, the position part 20 is inserted into the through-hole portion 12 to allow a portion of the stepped portion 243 of the outer diameter reduction portion 24 to come into contact with a portion of the stepped portion correspondence portion 121*a* of the through-hole portion 12 (See FIG. 6).

At this time, the position part 20 is not completely inserted into the through-hole portion 12, and the rotary member R is inserted into the accommodation space defined by the second curved surface 262 of the deformation portion 26 to apply the rotary force to the position part 20. Otherwise, the contact surface 263*c* protruding from the first slant surface 263*a* is grasped by a portion (finger) of the user's body, and in this state, if the rotary force of the rotary member R is applied, the position part 20 rotates in the state of being inserted into the through-hole portion 12 (See FIG. 7).

In this case, the stepped portion 243 spirally formed in the insertion direction of the position part 20 slidingly comes into contact with the stepped portion correspondence portion 121*a*, so that it completely comes into contact with the stepped portion correspondence portion 121*a*.

Also, the large diameter portion 22, the first parallel portion 241, and the second parallel portion 242 of the position part 20 are inserted into the through-hole portion 12 and thus come into contact with the inner peripheral surface of the through-hole portion 12.

When the position part 20 is inserted into the through-hole portion 12, the movement of the position part 20 to the second surface P2 of the through-hole portion 12 is prevented by means of the shape of the outer diameter reduction portion 24 and at the same time by means of the contact between the stepped portion 243 and the stepped portion correspondence portion 121*a*.

When the rotation of the position part 20 is finished, further, the other side surface of the outer diameter reduction portion 24 is located on the same plane as the second surface P2.

In rotating the position part 20, it is checked by the user whether the other side surface of the outer diameter reduction portion 24 is located on the same plane as the second surface P2. Accordingly, it can be checked whether the position part 20 is completely inserted into the through-hole portion 12.

Figure 8:
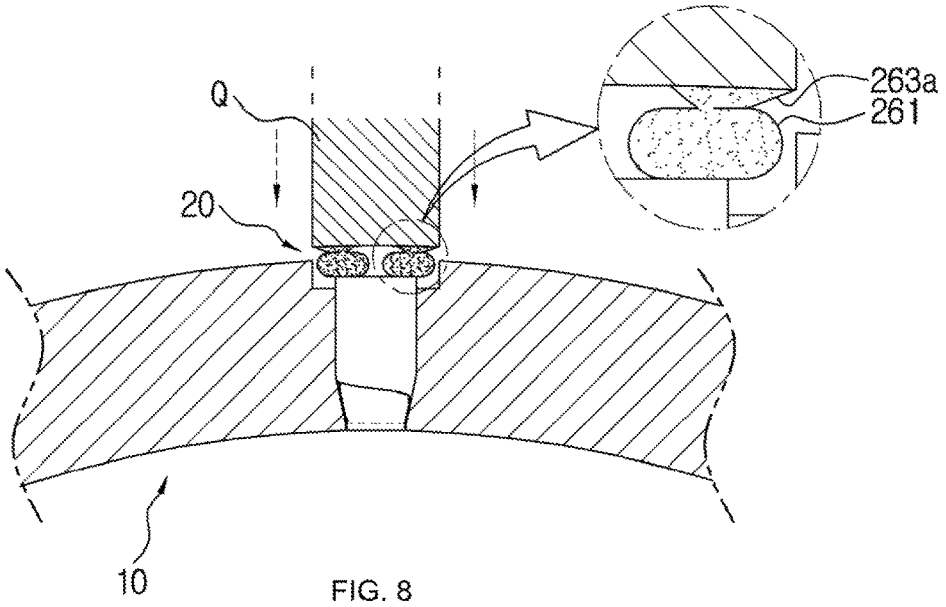

Next, the deformation portion 26 is pressurized through the external force application part Q (See FIG. 8). The surface of the external force application part Q which faces the fuse housing 10 is formed to the shape corresponding to the first surface P1.

For example, the first surface P1 of the fuse housing 10 is rounded like the external surface of the typical projectile, and the surface of the external force application part Q which faces the fuse housing 10 is also rounded to the same shape as the first surface P1.

Figure 9:
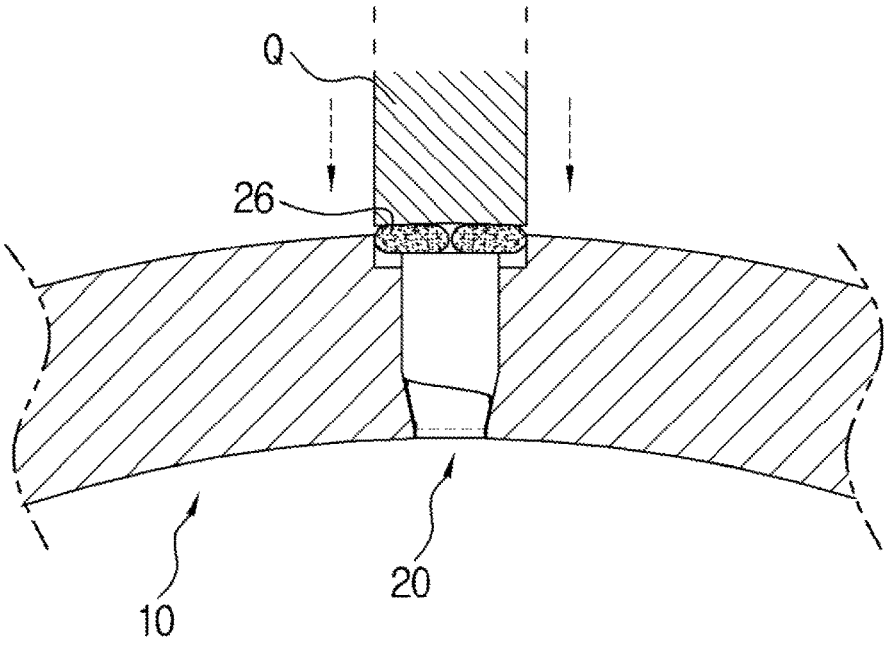

When the external force application part Q comes into contact with the contact surface 263*c* of the deformation portion 26, further, it applies a given pressure to the deformation portion 26, and at this time, the contact surface 263*c* is deformed to the shape parallel with the first surface P1 (See FIG. 9).

At this time, the first slant surface 263*a* comes into contact with the first curved surface 261. The boundary area between the first curved surface 261 and the first slant surface 263*a* is at the innermost position in the inward radial direction, and accordingly, the boundary area is first deformed by means of the external force applied from the external force application part Q.

If the second slant surface 263*b* comes into contact with the second curved surface 262 after the first slant surface 263*a* comes into contact with the first curved surface 261, the contact surface 263*c* is located appropriately in parallel with the first surface P1.

If the external force from the external force application part Q is continuously applied, a portion of the deformation portion 26 defined by the first curved surface 261 and the second curved surface 262 is deformedly buried into the space formed by the third through-hole portion 123.

At this time, the movement of the position part 20 to the second surface P2 of the through-hole portion 12 is first prevented by means of the shape of the outer diameter reduction portion 24 and is secondarily prevented by means of the contact between the stepped portion 243 and the stepped portion correspondence portion 121*a*, so that only the deformation portion 26 is deformed by the external force applied from the external force application part Q.

Through the external force applied from the external force application part Q, also, the position part 20 comes into closer contact with the first through-hole portion 121 and the second through-hole portion 122. In this case, an adhesive is applied to the outer peripheral surface of the large diameter portion 22 or between the outer peripheral surface of the outer diameter reduction portion 23 and the inner peripheral surface of the through-hole portion 12, thereby improving the coupling force between the fusing housing 10 and the position part 20.

As mentioned above, further, the size of space formed by the third through-hole portion 123 is equal to or larger than the size of volume of the deformation portion 26 deformed by the external force, and accordingly, if the facing surface of the external force application part Q comes into contact with the first surface P1, the deformation portion 26 is completely buried into the third through-hole portion 123.

Figure 10:
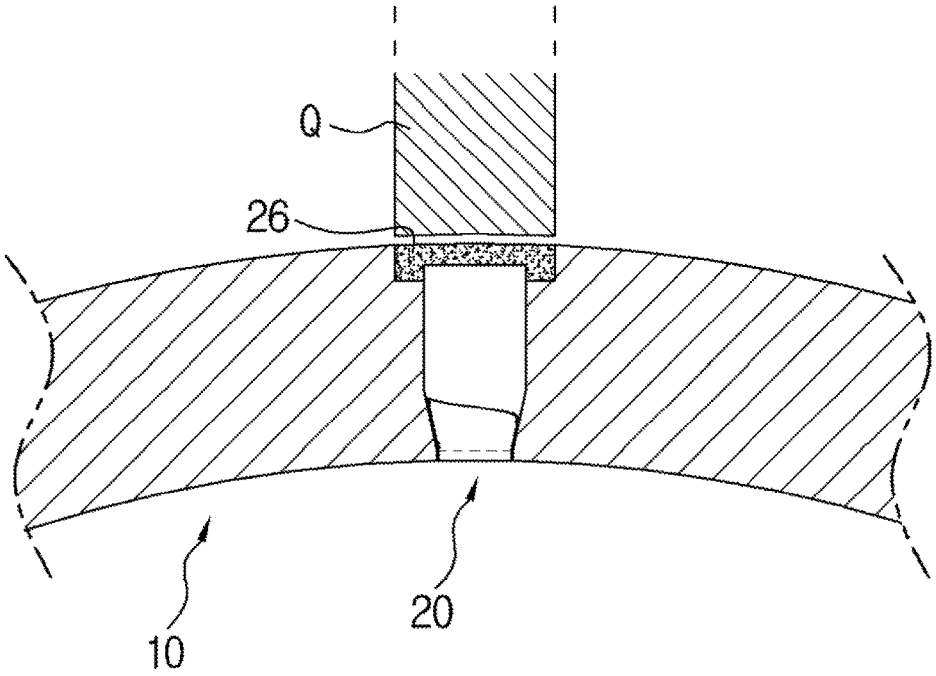

If the deformation portion 26 is completely buried into the third through-hole portion 123, the first surface P1 of the fuse housing 10 becomes smooth through turning (See FIG. 10).

Figure 11:
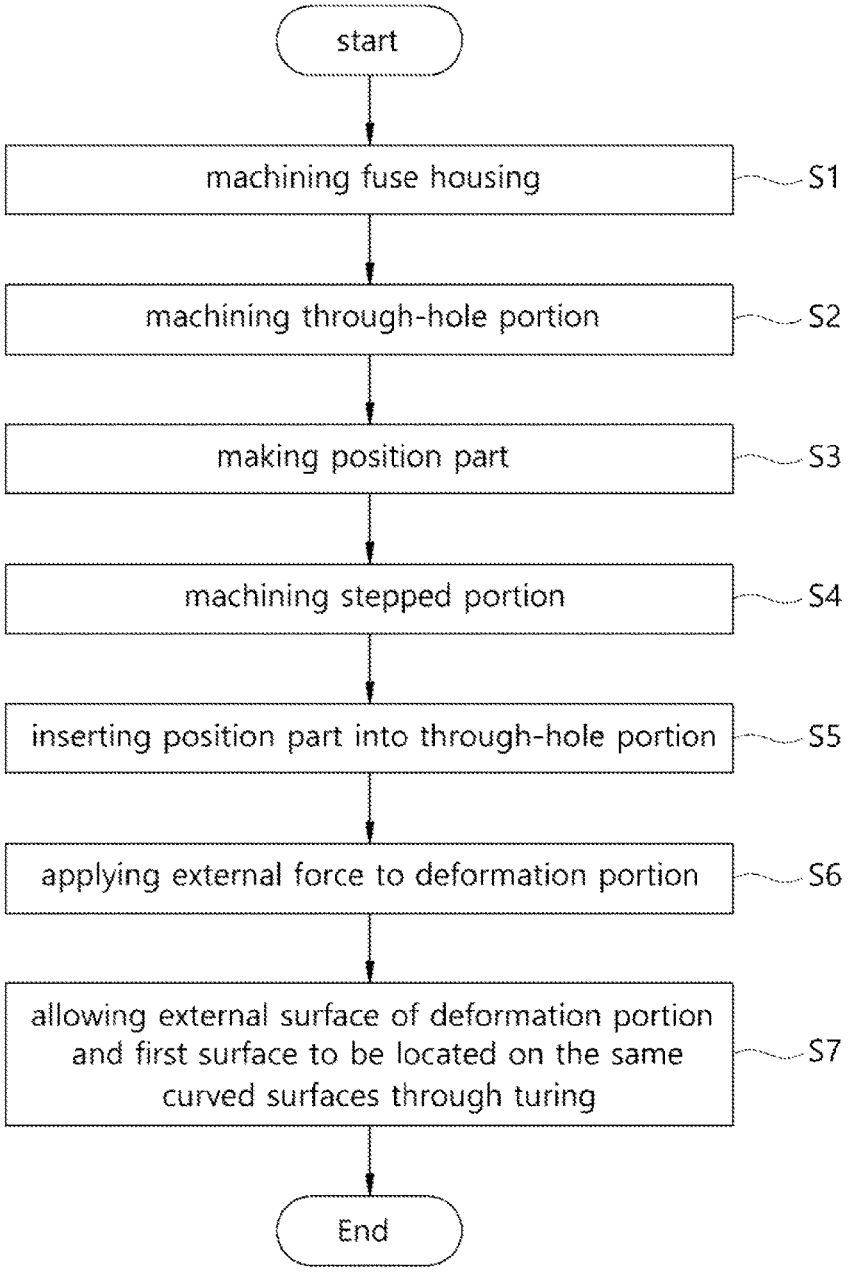
FIG. 11 is a flowchart showing a method for manufacturing a fuse housing structure according to the present invention.

FIG. 11 is a flowchart showing a method for manufacturing a fuse housing structure according to the present invention.

Referring now to FIGS. 5 to 11, a method for manufacturing the fuse housing structure 1 according to the present invention will be explained, and components in the method for manufacturing the fuse housing structure 1 are the same as those in the fuse housing structure 1 as mentioned above.

Further, the same components have the same shapes and functions as each other, and repeated explanations on them will be avoided for the brevity of the description.

The method for manufacturing the fuse housing structure 1 according to the present invention includes the first to seventh steps S1 to S7.

The first step S1 is a step of machining a cut metal round bar to a shape of a fuse housing 10 through a lathe.

Next, at the second step S2, a through-hole portion 12 is machined to pass through a first surface P1 exposed to the outside and a second surface P2 hidden to the interior of a projectile.

In this case, the through-hole portion 12 may be machined by means of a milling machine of the lathe.

After, at the third step S3, a position part 20 is made by machining a large diameter portion 22 having a first outer diameter, an outer diameter reduction portion 24 connected to one side of the large diameter portion 22 in such a manner as to allow one side connected to one side of the large diameter portion 22 to have the first outer diameter and to allow the other side thereof to have the first outer diameter reduced gradually, and a deformation portion 26 protruding from the other side of the large diameter portion 22.

In this case, the third step S3 is carried out by means of a CNC lathe.

Next, the fourth step S4 is carried out so that a stepped portion 243 is machined in such a manner as to be stepped along the outer peripheral surface of the outer diameter reduction portion 24. The stepped portion 243 is spirally formed from one side of the outer diameter reduction portion 24 toward the other side thereof.

After that, the fifth and sixth steps S5 and S6 are carried out to couple the fuse housing 10 and the position part 20 completely machined to each other.

In more detail, the fifth step S6 is a step of inserting the position part 20 into the through-hole portion 12, and at this time, the position part 20 is not completely inserted into the through-hole portion 12.

After the position part 20 is inserted into the through-hole portion 12, the spirally stepped portion 243 completely comes into contact with the stepped portion correspondence portion 121*a* of the through hole-portion 12 through the application of a rotary force, and if the contact is finished, the other side surface of the outer diameter reduction portion 24 is located on the same plane as the second surface P2.

In this case, the rotary force applied to the position part 20 is generated by the rotary member R inserted into the space defined by the second curved surface 262 of the deformation portion 26 or by the contact surface 263*c* protruding from the first slant surface 263*a*.

After that, the sixth step S6 is a step of applying an external force to the deformation portion 26 protruding from the first surface P1, which is carried out by means of the contact and pressurization of an external force application part Q with the contact surface 263*c* of the deformation portion 26.

The deformation of the deformation portion 26 caused by the external force application part Q have been in detail explained with reference to FIGS. 5 to 10.

After the sixth step S6, the deformation portion 26 of the position part 20 is buried into the third through-hole portion 123 of the fuse housing 10.

Next, the first surface P1 of the fuse housing 10 becomes smooth through turning in such a manner as to be located on the same curved surface as the external surface of the deformation portion 26, and accordingly, a surface where the through-hole portion 12 is not formed on the first surface P1 of the fuse housing 10 is located on the same curved surface as a surface where the through-hole portion 12 is formed thereon.

As described above, the fuse housing structure according to the present invention is capable of coupling the position part to the fuse housing in simple, easy, precise, and accurate manners.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

I claim:

1. A fuse housing structure comprising:

a fuse housing coupled to a projectile and having a first surface exposed to exterior, a second surface facing an interior of the projectile, and a through-hole portion formed between the first surface and the second surface; and a position part being deformable by an external force so as to be insertable into the through-hole portion so as to be coupled to said fuse housing, said position part comprising:

a large diameter portion having a first outer diameter;

an outer diameter reduction portion connected to one side of said large diameter portion such that said first outer diameter is connected to one side of the large diameter portion, another side of said large diameter portion having a reduced diameter of said first outer diameter there at, and a deformation portion protruding from the another side of the large diameter portion into the through-hole portion by the deformation caused by the external force, and the through-hole portion comprising:

a first through-hole portion recessed from the second surface of the fuse housing and having a shape corresponding to the shape of the outer diameter reduction portion;

a second through-hole portion communicating with the first through-hole portion and having a shape corresponding to the shape of the large diameter portion; and a third through-hole portion recessed from the first surface and communicating with the second through-hole portion, wherein a size of a volume formed by the third through-hole portion is equal to or larger than a size of volume of a deformed portion deformed by the external force, wherein the outer diameter reduction portion has a stepped portion spirally formed thereon in a direction of insertion, wherein the first through-hole portion has a stepped portion correspondence portion formed thereon to have a shape corresponding to the stepped portion, the position part being rotatable along the through-hole portion by contact between the stepped portion and the stepped portion correspondence portion, wherein when the position part is inserted into the through-hole the another side surface of the outer diameter reduction portion is located on a common plane with the second surface when a rotation of the position part is finished.

2. The fuse housing structure of claim 1, wherein the outer diameter reduction portion comprises:

a first parallel portion where the first outer diameter is constant; and a second parallel portion having a second outer diameter smaller than the first outer diameter, wherein the stepped portion is formed between the first parallel portion and the second parallel portion.

3. The fuse housing structure of claim 1, wherein the third through-hole portion has a first inner diameter larger than the first outer diameter, the deformation portion comprising:

a first curved surface having an outer diameter larger than the first outer diameter and smaller than the first inner diameter in such a manner as to be curved in an outward radial direction;

a second curved surface having an inner diameter smaller than the first outer diameter in such a manner as to be curved in an inward radial direction; and a connection surface connecting the first curved surface and the second curved surface with each other.

4. The fuse housing structure of claim 3, wherein the connection surface comprises:

a first slant surface opposing the first curved surface in such a manner as to form a given slant surface with respect to the first surface;

a second slant surface opposing the second curved surface in such a manner as to form another given slant surface with respect to the first surface; and a contact surface connecting the first slant surface and the second slant surface with each other in such a manner as to contact an application part from which the external force is applied, such that acute angle is formed by an imaginary plane extended from the contact surface and the first surface when the external force is applied to the contact surface, the first curved surface and the first slant surface come into contact with each other to allow the deformation portion to be insertable into the third through-hole portion, and a boundary area between the first curved surface and the first slant surface is at an innermost position in the inward radial direction.

5. The fuse housing structure of claim 3, wherein an accommodation space is defined by the second curved surface in which a rotary member is insertable so that the position part rotates along the through-hole portion.

* * * * *